US006491345B1

(12) United States Patent
Shepard

(10) Patent No.: US 6,491,345 B1
(45) Date of Patent: Dec. 10, 2002

(54) SEAT HAVING INTERCHANGEABLE INSERTS

(75) Inventor: Randall B. Shepard, Moraga, CA (US)

(73) Assignee: McGuire Furniture Company, Inc., San Francisco, CA (US)

( * ) Notice: Subject to any disclaimer, the term of this patent is extended or adjusted under 35 U.S.C. 154(b) by 0 days.

(21) Appl. No.: 09/657,403

(22) Filed: Sep. 8, 2000

(51) Int. Cl.[7] ..... A47C 7/00
(52) U.S. Cl. ..... 297/440.22; 297/440.2
(58) Field of Search ..... 297/440.1, 440.14, 297/440.2, 440.22, 452.64, 452.63, 452.18

(56) References Cited

U.S. PATENT DOCUMENTS

| | | | | |
|---|---|---|---|---|
| 192,203 | A | | 6/1877 | Wakeman |
| 194,389 | A | | 8/1877 | Wakeman |
| 2,259,534 | A | | 10/1941 | Reynolds et al. |
| 2,783,828 | A | | 3/1957 | Weill |
| 2,864,438 | A | | 12/1958 | Levine |
| 3,233,942 | A | * | 2/1966 | Creutz |
| 3,318,635 | A | * | 5/1967 | Berecki et al. |
| 3,455,604 | A | | 7/1969 | Turcksin |
| 3,695,691 | A | | 10/1972 | Putnam |
| 3,981,537 | A | | 9/1976 | Wright |
| RE29,522 | E | * | 1/1978 | Barecki |
| 4,300,455 | A | * | 11/1981 | Ornati |
| 4,305,616 | A | * | 12/1981 | Martinez |
| 4,597,606 | A | | 7/1986 | Magee |
| 4,768,833 | A | * | 9/1988 | Virtue |
| 4,848,839 | A | | 7/1989 | Galardo |
| 4,904,022 | A | * | 2/1990 | Morozzi |
| 5,263,764 | A | | 11/1993 | Laughlin et al. |
| 5,346,285 | A | | 9/1994 | West, III |
| 5,779,317 | A | * | 7/1998 | Neal |
| 5,795,028 | A | | 8/1998 | Dussia, Jr. et al. |
| D403,875 | S | | 1/1999 | Grosfillex |
| D403,876 | S | | 1/1999 | Grosfillex |
| 6,199,948 | B1 | * | 3/2001 | Bush et al. |
| 6,217,120 | B1 | * | 4/2001 | Pugliese |

FOREIGN PATENT DOCUMENTS

| | | |
|---|---|---|
| DE | 43 32 302 A1 | 9/1993 |
| EP | 0 210 710 A2 | 2/1987 |
| EP | 0 562 935 A1 | 3/1996 |
| FR | 2 662 062 | 11/1991 |
| FR | 2 700 455 A1 | 7/1994 |
| GB | 2 151 133 A | 7/1985 |

* cited by examiner

*Primary Examiner*—Milton Nelson, Jr.
(74) *Attorney, Agent, or Firm*—Merchant & Gould P.C.

(57) ABSTRACT

A seat is provided which includes a first frame member having an inner rim and top surface and forms a seat bottom frame. The seat includes a plurality of legs extending downward from the first frame member. A second frame member having an inner rim and top surface is connected to the first frame member and extends upward to form a seat back frame. The seat includes a first insert member having an outer rim and a top surface and is adapted to fit within the first frame member so that the first insert member is releasably secured to the first frame member and preferably the outer rim of the first insert member is disposed adjacent the inner rim of the first frame member so that the top surface of the first insert member is substantially flush with the top surface of the first frame member. The seat preferably includes a second insert member having an outer rim and a top surface adapted to fit within the second frame member where the second insert member is releasably secured to the second frame member such that the outer rim of the second insert member is disposed adjacent the inner rim of the second frame member so that the top surface of the second insert member is substantially flush with the top surface of the second frame member. The first and second insert members are secured in releasable connection to the first and second frame members so that the insert members may be interchanged with other insert members to change the visual appearance of the seat bottom and seat back.

5 Claims, 7 Drawing Sheets

SEAT HAVING INTERCHANGEABLE INSERTS

BACKGROUND OF THE INVENTION

1. Field of the Invention

This invention relates to a seat apparatus having interchangeable inserts.

2. Brief Description of the Art

In the area of furniture design, there are numerous varieties of seat frames having a seat bottom and seat back with a particular visual appearance. It is known in furniture design to utilize the same frame of a chair in which the seat back and seat base portions of the chair have different visual appearances. However, in such a case, a person who desires different visual appearances needs to substitute a different chair including the frame and seat and back portions. What is needed is a seat having interchangeable inserts to easily and conveniently change the visual appearance of the seat.

SUMMARY OF THE INVENTION

The present invention relates to a seat apparatus having an interchangeable insert.

A preferred seat includes a first frame member having an inner rim and a top surface and forming a seat bottom frame and a plurality of legs extending downward from the first frame member. The seat includes a second frame member having an inner rim and a top surface and connected to the first frame member and extending upward to form a seat back frame. The seat preferably includes a first insert member having an outer rim and a top surface adapted to fit within the first frame member where the first insert member is releasably secured to the first frame member such that the outer rim of the first insert member is disposed adjacent the inner rim of the first frame member so that the top surface of the first insert member is substantially flush with the top surface of the first frame member. Preferably, the seat includes a second insert member having an outer rim and a top surface and adapted to fit within the second frame member where the second insert member is releasably secured to the second frame member such that the outer rim of the second insert member is disposed adjacent the inner rim of the second frame member so that the top surface of the second insert member is substantially flush with the top surface of the second frame member. Preferably, the first and second insert members are secured in releasable connection to the first and second frame members respectively so that the insert members may be interchanged with other insert members to change the visual appearance of the seat bottom and seat back.

In one embodiment, the first frame member includes a plurality of tabs extending inward from the inner rim of the first frame member with each of the tabs having an aperture therein so that a bottom surface of the first insert member is disposed against the plurality of tabs and a fastener member is secured through the aperture in the tab to releasably secure the first insert member to the first frame member.

In another embodiment, the inner rim of the second frame member includes an upper edge and a lower edge with each edge having an aperture therein. The outer rim of the second insert member includes an upper end and a lower end where the upper end of the outer rim includes a pin extending outward from the rim and is disposed for disposition in the aperture in the upper edge of the second frame member. A fastener member is extendable through the aperture in the lower edge of the second frame member for engagement with the lower end of the second insert member to releasably secure the second insert member to the second frame member.

In one embodiment, the upper edge and lower edge of the inner rim of the second frame member each include a plurality of apertures with the upper edge of the outer rim of the second insert member having a plurality of pins extending outward from the rim and disposed for disposition in the plurality of apertures in the upper edge of the second frame member. Further, a plurality of fastener members are extendable through the plurality of apertures in the lower edge of the second frame member for engagement with the lower end of the second insert member to releasably secure the second insert member to the second frame member.

In one embodiment of the invention, the seat includes an additional first insert member adapted to fit within the first frame member and having a top surface having a different visual appearance than the first insert member so that the additional first insert member may be interchanged with the first insert member in releasable connection to the first frame member of the seat to change the visual appearance of the seat bottom.

DETAILED DESCRIPTION OF THE PREFERRED EMBODIMENTS

Figure 1:
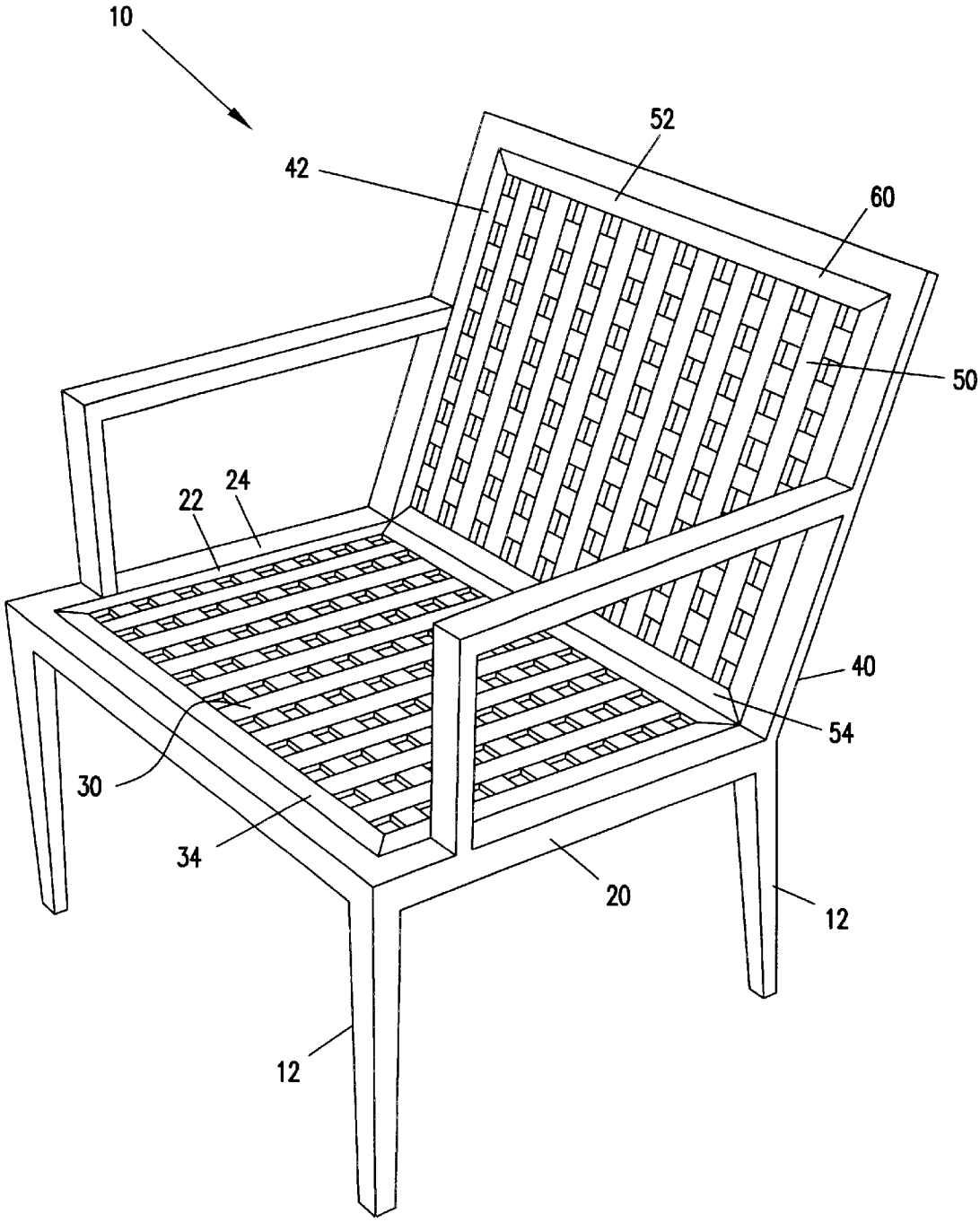
FIG. 1 is a perspective view of a first embodiment of a seat in accordance with the present invention.

Referring now to FIGS. 1–7, several embodiments of the seat 10 are shown. In one embodiment, the seat includes a bottom frame member 20 having legs 12 extending downward from the bottom frame member. A seat back frame member 40 extends upward from the bottom frame member 20 and arms 14 extend between the seat back frame member 40 and bottom frame member 20. It is appreciated that the seat may take a variety of forms such as a chair, loveseat, couch, or other seat forms. In this embodiment it is shown in the form of a chair for illustrative purposes.

The bottom frame member 20 includes an inner rim 22 and a top surface 24. A bottom insert member 30 is designed to fit within the inner rim 22 of the bottom frame member 20 to form the seat bottom. The bottom insert member 30 is designed to be releasably secured within the inner rim 22 of the bottom frame member 20. In one embodiment, the bottom frame member 20 includes tabs 26 having apertures 28 therein so that the bottom insert member 30 rests on the tabs 26 of the bottom frame member 20. The bottom insert member 30 preferably includes apertures 32 that correspond to the apertures 28 and the tabs 26 of the bottom frame member. An appropriate fastener such as a screw 29 is then secured through the apertures 28 in the tabs 26 into the apertures 32 of the bottom insert member 30 to releasably secure the bottom insert member in place within the inner rim 22 of the bottom frame member 20. It is appreciated that each tab 26 has at least one aperture 28 for an appropriate fastener.

Figure 2:
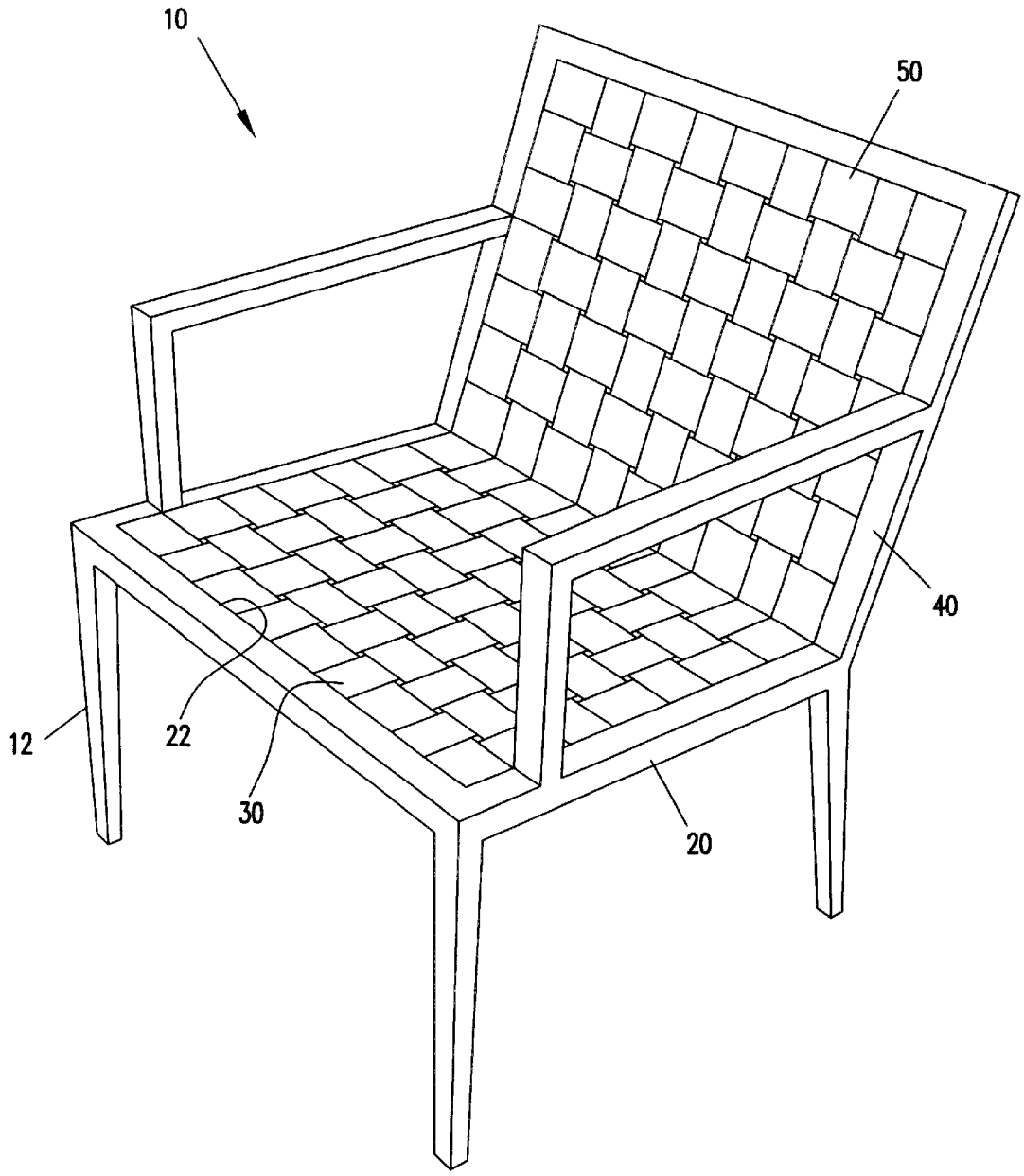
FIG. 2 is a perspective view of a second embodiment of a seat in which the back and seat bottom inserts have a different visual appearance than that shown in FIG. 1.
Figure 3:
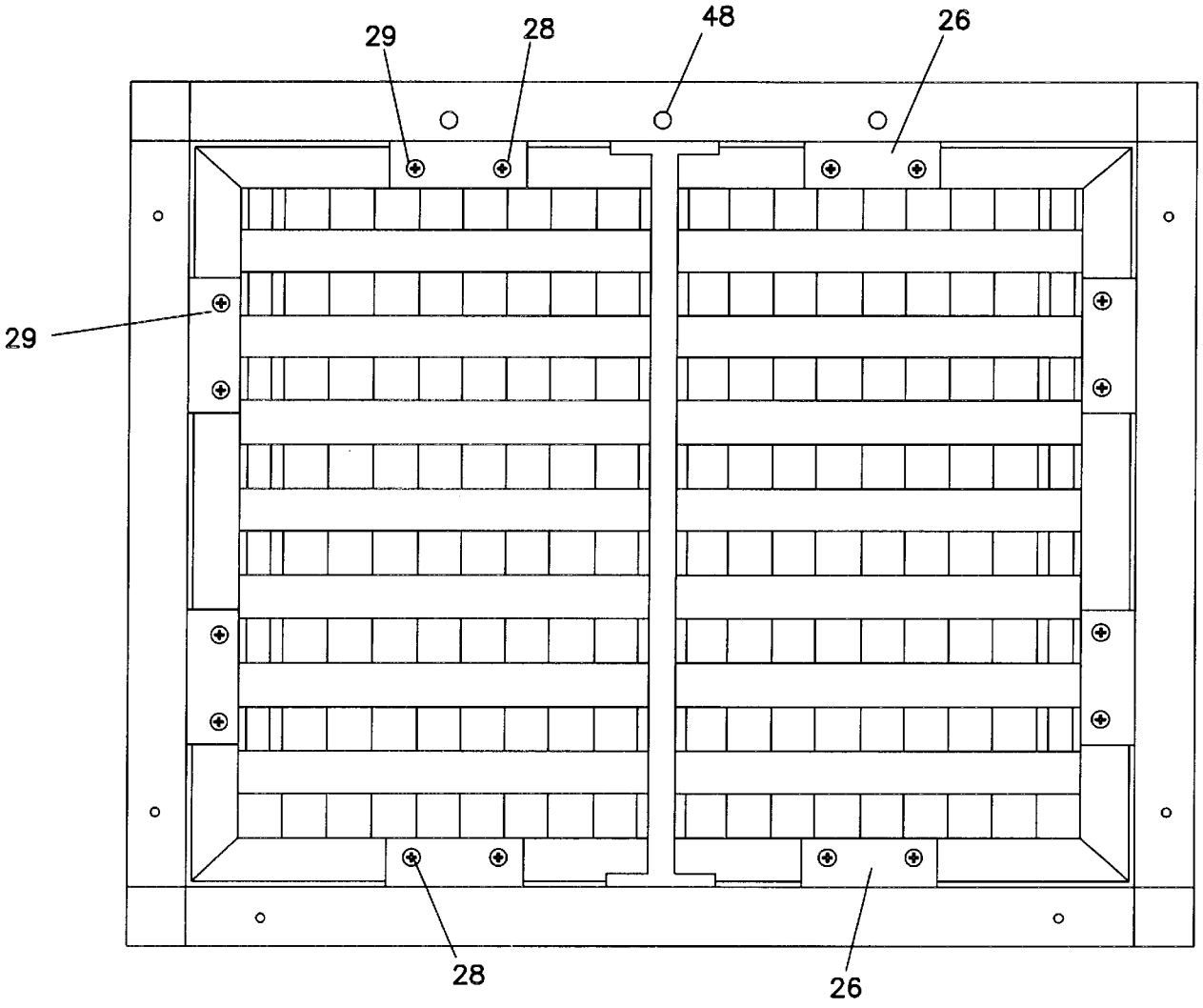
FIG. 3 is a bottom view of the seat of FIG. 1.
Figure 4:
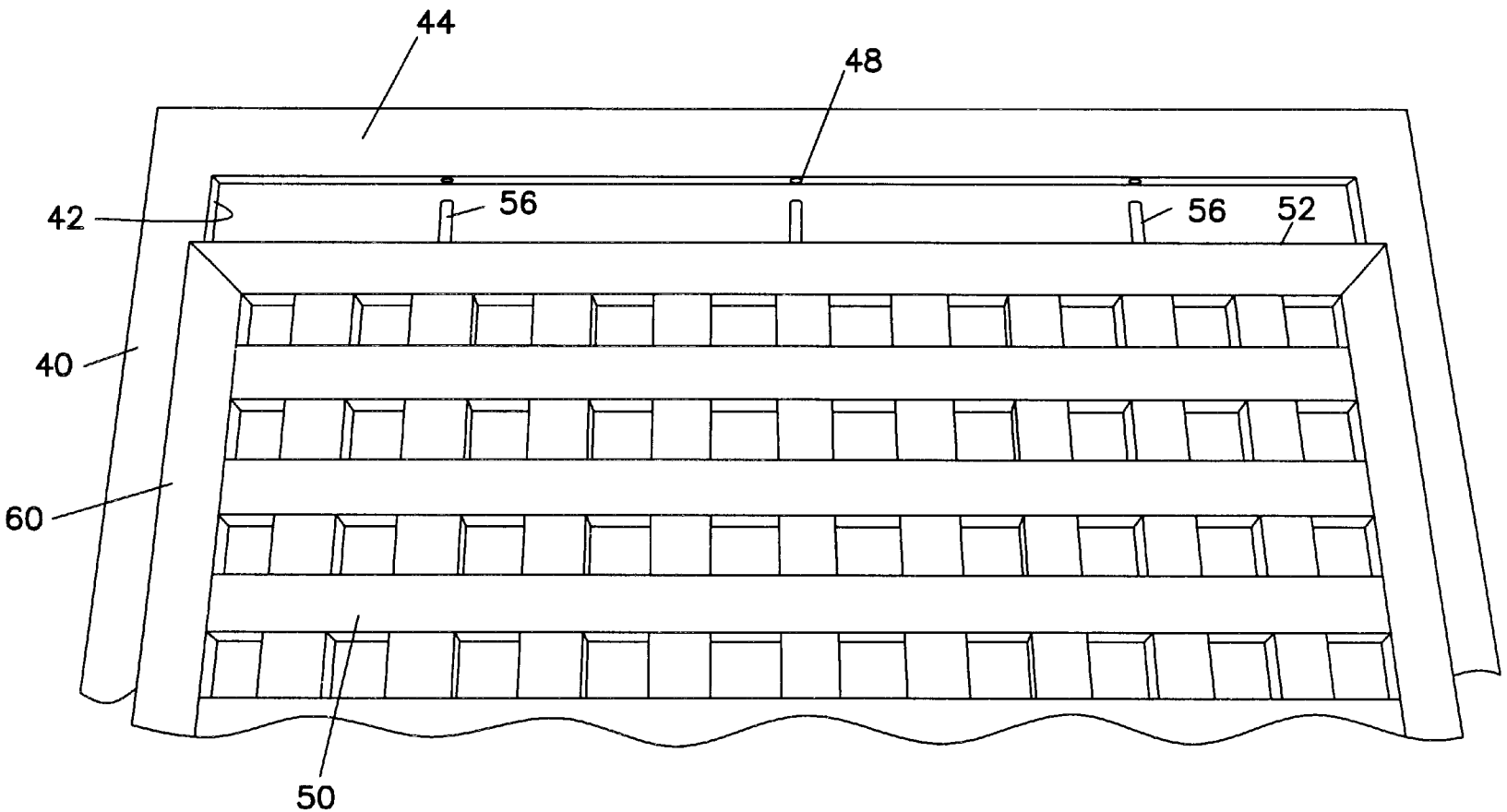
FIG. 4 is a partial front view of a portion of the seat back of the seat of FIG. 1 shown with the back insert disengaged from the seat frame.
Figure 5:
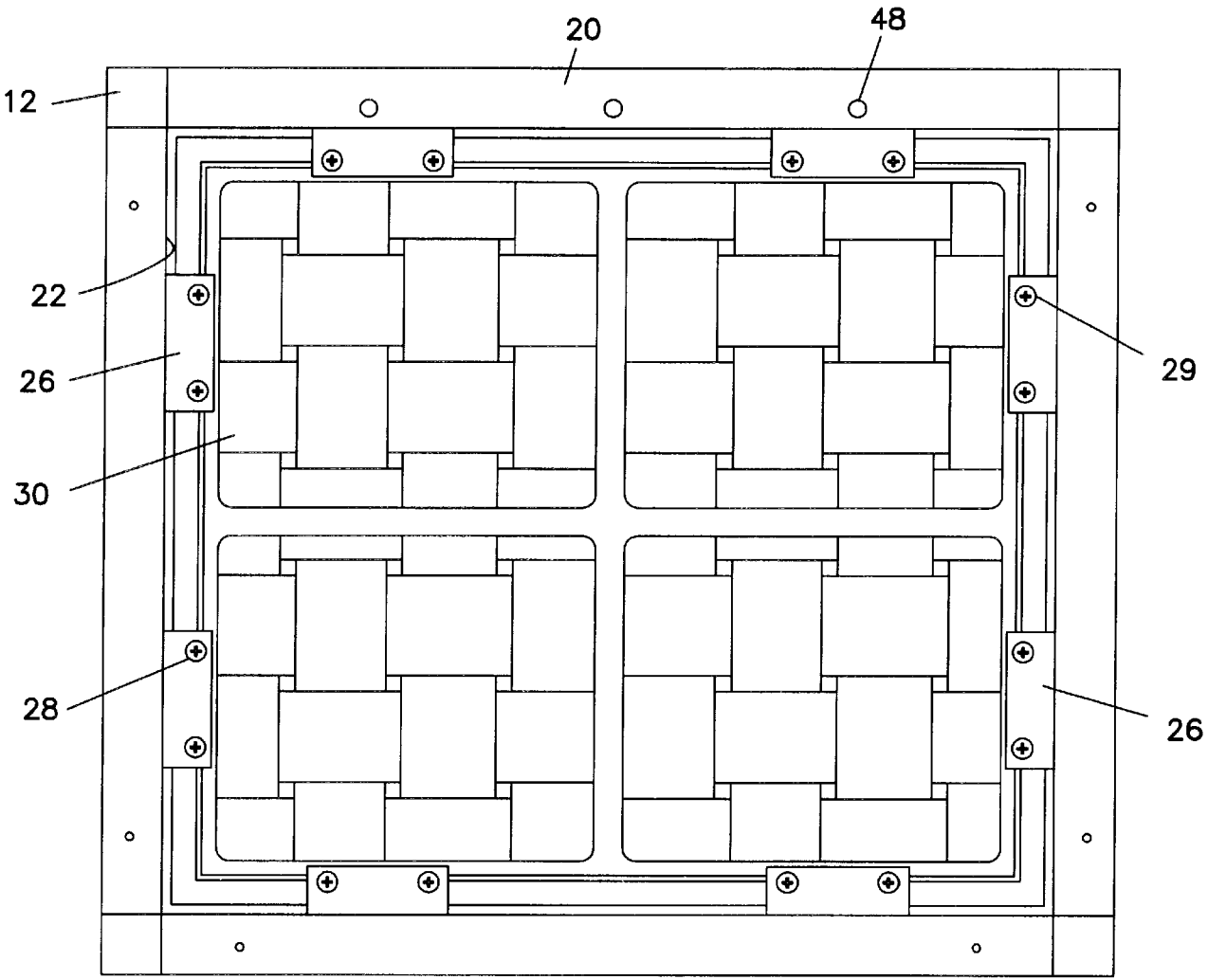
FIG. 5 is a bottom view of the seat of FIG. 2.
Figure 6:
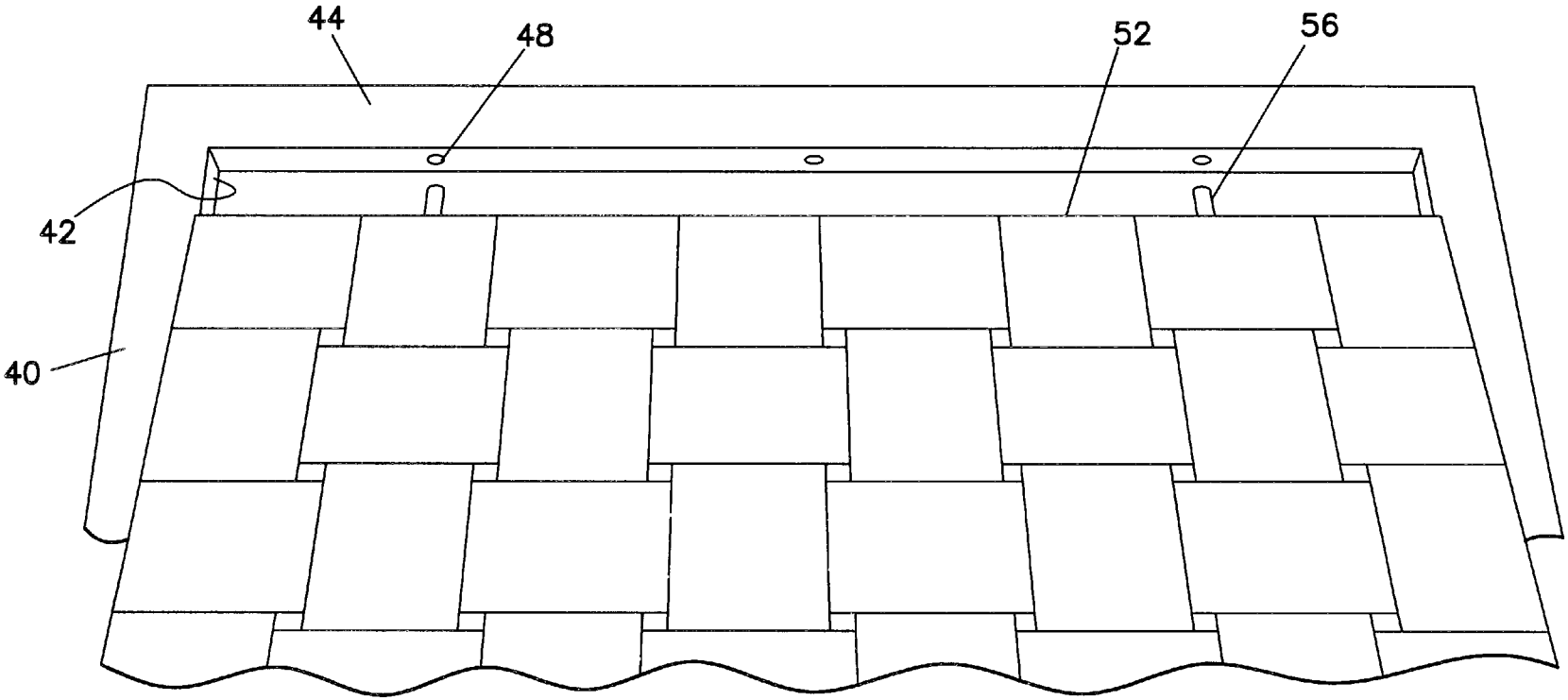
FIG. 6 is a partial front view of the back portion of the seat of FIG. 2 shown with the back insert disengaged from the seat frame.
Figure 7:
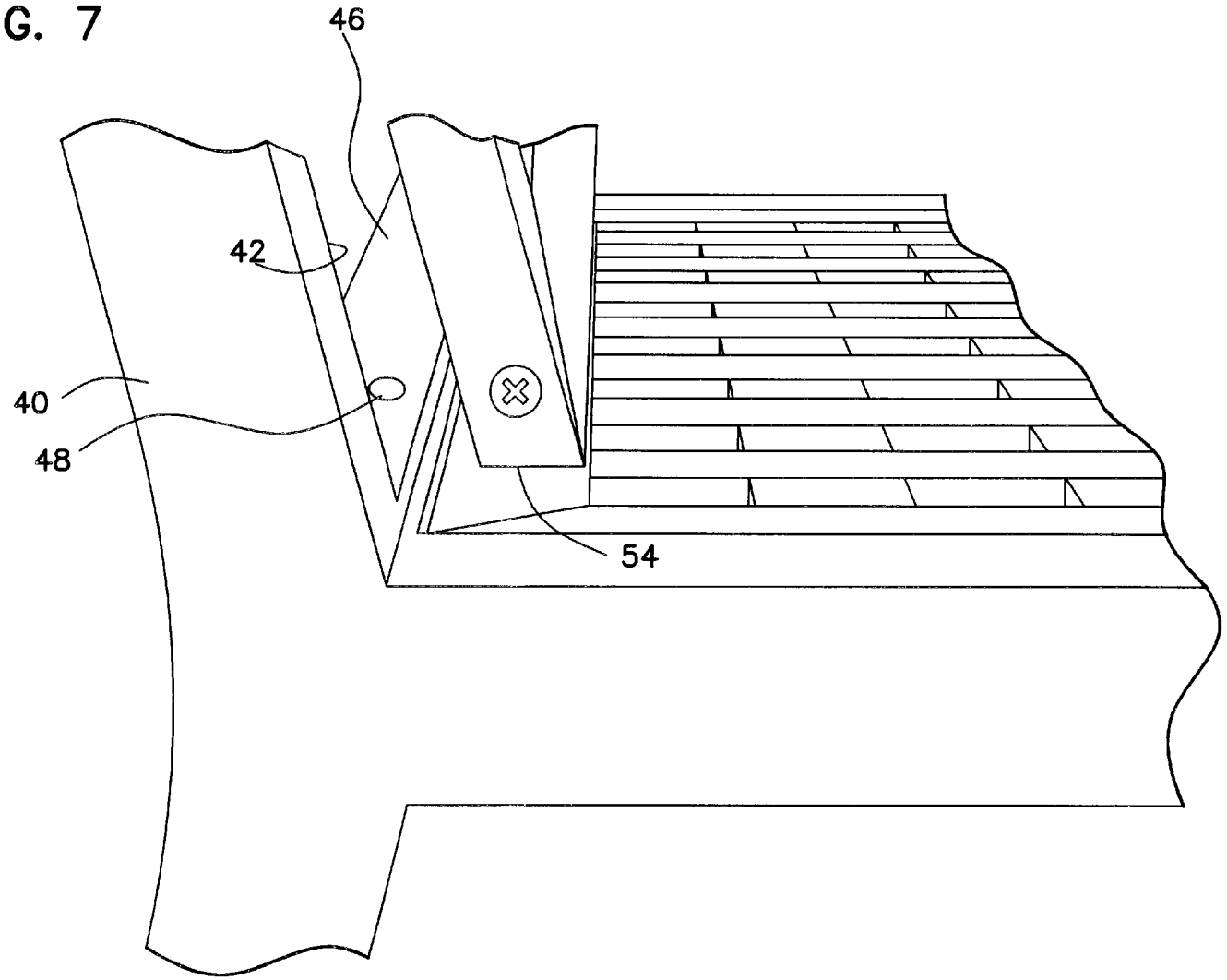
FIG. 7 is a partial side view of the seat of FIG. 1 shown with the lower portion of the back insert removed from the seat frame.

In this example, the bottom insert member 30 takes the appearance of a teak wood form. The invention contemplates that other bottom insert members having a different visual appearance may be interchanged with the bottom insert member 30 to change the visual appearance of the seat 10. For example, referring to FIG. 2, a seat is shown in which the bottom insert member 30 is formed from a webbed material and has a different visual appearance than the bottom insert member shown in FIG. 1. The invention contemplates that a user may remove the fasteners that hold the bottom insert member 30 in place and interchange the bottom insert member 30 with a bottom insert member having a different visual appearance. In such a case, after the first bottom insert member 30 is removed, the second bottom insert member 30 such as shown in FIG. 2 would be placed adjacent the inner rim 22 of the bottom frame member 20 and the fasteners 29 would then be secured to releasably retain the second bottom insert member 30 within the bottom frame member 20 to easily change the visual appearance of the chair.

In a preferred embodiment, the bottom insert member 30 is securely retained within the bottom frame member 20 such that the top surface 34 of the bottom insert member 30 is substantially flush with the top surface 24 of the bottom frame member 20. This allows for comfortable seating by the user.

In accordance with another embodiment of the present invention, the seat 10 preferably includes a seat back insert member 50 which is designed to fit within the inner rim 42 of the seat back frame member 40. Referring to FIG. 1, the back insert member 50 includes an upper end 52 and a lower end 54 and is designed to fit within the inner rim 42 of the seat back frame member 40 for releasable connection therein. In one embodiment, the seat back frame member 40 includes apertures 48 in the upper edge 44 and lower edge 46 of the seat back frame member 40 designed for engagement with corresponding pins 56 in the upper end 52 of the seat back insert member 50 (see FIGS. 4 and 6). The lower end 54 of the seat back insert member 50 preferably includes apertures that correspond to the apertures 48 in the lower edge 46 of the seat back frame member 40 so that an appropriate fastener such as a screw may be inserted through the lower edge 46 of the seat back frame member 40 to releasably retain the back insert member 50 within the seat back frame member 40. Similar to the bottom insert member, the back insert member 50 is designed to be interchangeable with other back insert members having a different visual appearance than the initial back insert member 50. For example, in FIG. 2, a back insert member 50 is shown that has a different visual appearance (web design) than the teak wood design shown in FIG. 1. Accordingly, a user can remove the fasteners from the bottom of the seat back frame member 40 and then remove the back insert member 50 from the seat back frame member 40 and then insert a new back insert member 50 having a different visual appearance by first lining up the pins 56 on the upper end 52 of the back insert member 50 into the corresponding apertures 48 on the upper edge 44 of the seat back frame member. The user then inserts the fasteners through the apertures 48 in the seat back frame member 40 to secure the back insert member 50 in place. Similar to the bottom insert member, the seat back insert member 50 is preferably designed to be retained within the seat back frame member 40 such that the top surface 60 of the back insert member 50 is substantially flush against the top surface 49 of the seat back frame member 40. This again allows for comfortable seating by the user.

It is appreciated that other methods may be utilized to securely and releasably retain the insert members within the frame of the seat. For example, clips or other types of fasteners may be used in accordance with the principles of the present invention. It is further appreciated that the invention contemplates that either the seat back or seat bottom insert or both may be interchanged to change the visual appearance of the chair.

It is to be understood that even though numerous characteristics and advantages of various embodiments of the present invention have been set forth in the foregoing description, together with the details of the structure and function of various embodiments of the invention, this disclosure is illustrative only and changes may be made in the details, especially in matters of size, shape, and arrangements of the parts within the principles of the present invention to the full extent indicated by the broad general meaning of the terms in which the appending claims are expressed. All alternative modifications and variations of the present invention which fall within the spirit and broad scope of the appending claims are covered.

What is claimed is:

1. A seat comprising:

a first frame member having an inner rim and a top surface and forming a seat bottom frame, wherein the first frame member includes a plurality of tabs extending inward from the inner rim of the frame member, each of the tabs having an aperture therein;

a plurality of legs extending downward from the first frame member;

a seat back connected to the first frame member and extending upward from the first frame member;

an insert member having an outer rim and a top surface and adapted to fit within the first frame member, wherein the insert member is releasably secured to the frame member such that the outer rim of the insert member is disposed adjacent the inner rim of the frame member and wherein the top surface of the insert member is substantially flush with the top surface of the frame member;

wherein a bottom surface of the insert member is disposed against the plurality of tabs and a fastener member is secured through the aperture in the tab to releasably secure the insert member to the first frame member such that the insert member may be interchangeable with other insert members to change the visual appearance of the seat bottom.

2. A seat comprising:

a seat bottom;

a plurality of legs extending downward from the seat bottom;

a first frame member having an inner rim and a top surface and connected to the seat bottom and extending upward from the seat bottom to form a seat back frame, wherein the inner rim of the first frame member includes an upper edge and a lower edge, each edge having an aperture therein;

an insert member having an outer rim and a top surface and adapted to fit within the first frame member, wherein the outer rim of the insert member includes an upper end and a lower end, wherein the upper end of the outer rim includes a pin extending outward from the rim and disposed for disposition in the aperture in the upper edge of the first frame member, wherein the insert member is releasably secured to the first frame member such that the outer rim of the insert member is disposed adjacent the inner rim of the first frame member and wherein the top surface of the insert member is substantially flush with the top surface of the first frame member;

wherein a fastener member is extendable through the aperture in the lower edge of the first frame member for engagement with the lower end of the insert member to releasably secure the insert member to the first frame member such that the insert member may be interchanged with other insert members to change the visual appearance of the seat back.

3. A seat comprising:

a first frame member having an inner rim and a top surface and forming a seat bottom frame, wherein the first frame member includes a plurality of tabs extending inward from the inner rim of the frame member, each of the tabs having an aperture therein;

a plurality of legs extending downward from the first frame member;

a second frame member having an inner rim and a top surface and connected to the first frame member and extending upward to form a seat back frame wherein the inner rim of the second frame member includes an upper edge and a lower edge, each edge having an aperture therein;

a first insert member having an outer rim and adapted to fit within the first frame member, wherein the first insert member is releasably secured to the first frame member such that the outer rim of the first insert member is disposed adjacent the inner rim of the first frame member;

and a second insert member having an outer rim and adapted to fit within the second frame member, wherein the second insert member is releasably secured to the second frame member such that the outer rim of the second insert member is disposed adjacent the inner rim of the second frame member;

wherein a bottom surface of the first insert member is disposed against the plurality of tabs and a fastener member is secured through the aperture in the tab to releasably secure the first insert member to the first frame member, and wherein a fastener member is extendable through the aperture in the lower edge of the second frame member for engagement with the lower end of the second insert member to releasably secure the second insert member to the second frame member such that the first and second insert members may be interchanged with other insert members to change the visual appearance of the seat bottom and seat back.

4. A seat comprising:

a first frame member having an inner rim and a top surface and forming a seat bottom frame, wherein the first frame member includes a plurality of tabs extending inward from the inner rim of the frame member, each of the tabs having an aperture therein;

a plurality of legs extending downward from the first frame member;

a seat back connected to the first frame member and extending upward from the first frame member;

an insert member having an outer rim and a top surface and adapted to fit within the first frame member, wherein the insert member is releasably secured to the frame member such that the outer rim of the insert member is disposed adjacent the inner rim of the frame member;

wherein a bottom surface of the insert member is disposed against the plurality of tabs and a fastener member is secured through the aperture in the tab to releasably secure the insert member to the first frame member such that the insert member may be interchangeable with other insert members to change the visual appearance of the seat bottom.

5. A seat comprising:

a seat bottom;

a plurality of legs extending downward from the seat bottom;

a first frame member having an inner rim and a top surface and connected to the seat bottom and extending upward from the seat bottom to form a seat back frame, wherein the inner rim of the first frame member includes an upper edge and a lower edge, each edge having an aperture therein;

an insert member having an outer rim and a top surface and adapted to fit within the first frame member, wherein the outer rim of the insert member includes an upper end and a lower end, wherein the upper end of the outer rim includes a pin extending outward from the rim and disposed for disposition in the aperture in the upper edge of the first frame member, wherein the insert member is releasably secured to the first frame member such that the outer rim of the insert member is disposed adjacent the inner rim of the first frame member;

wherein a fastener member is extendable through the aperture in the lower edge of the first frame member for engagement with the lower end of the insert member to releasably secure the insert member to the first frame member such that the insert member may be interchanged with other insert members to change the visual appearance of the seat back.

* * * * *